US008662949B2

(12) United States Patent
McKinney

(10) Patent No.: US 8,662,949 B2
(45) Date of Patent: Mar. 4, 2014

(54) GLOW-IN-THE-DARK LIFE JACKET

(76) Inventor: Charles McKinney, Abilene, TX (US)

( * ) Notice: Subject to any disclaimer, the term of this patent is extended or adjusted under 35 U.S.C. 154(b) by 95 days.

(21) Appl. No.: 13/333,126

(22) Filed: Dec. 21, 2011

(65) Prior Publication Data

US 2012/0164898 A1 Jun. 28, 2012

Related U.S. Application Data

(60) Provisional application No. 61/426,005, filed on Dec. 22, 2010.

(51) Int. Cl.
*B63C 9/20* (2006.01)

(52) U.S. Cl.
USPC ..... 441/89; 362/108

(58) Field of Classification Search
USPC ..... 441/13, 16, 89; 362/103, 104, 108; 24/3.1; 313/483
See application file for complete search history.

(56) References Cited

U.S. PATENT DOCUMENTS

| | | | | |
|---|---|---|---|---|
| 3,893,938 | A * | 7/1975 | Rauhut | 252/700 |
| 4,578,042 | A | 3/1986 | Evert | |
| 4,598,661 | A * | 7/1986 | Roe | 116/209 |
| 5,370,566 | A * | 12/1994 | Mitchell et al. | 441/89 |
| 5,421,287 | A | 6/1995 | Yonover | |
| 5,603,648 | A * | 2/1997 | Kea | 441/89 |
| 6,257,942 | B1 | 7/2001 | Groover | |
| 6,270,386 | B1 | 8/2001 | Visocekas | |
| 7,018,258 | B2 | 3/2006 | McLarty | |
| 7,189,128 | B2 | 3/2007 | Halliday | |
| 7,220,011 | B2 * | 5/2007 | Hurwitz | 362/84 |
| 7,566,140 | B2 * | 7/2009 | Sevilla | 362/108 |
| 7,980,203 | B1 * | 7/2011 | Rubottom et al. | 119/858 |
| 8,186,021 | B2 * | 5/2012 | Gonzalez | 24/3.1 |
| 2008/0311805 | A1 | 12/2008 | Spears et al. | |
| 2010/0102065 | A1 | 4/2010 | Phelan | |
| 2010/0136862 | A1 | 6/2010 | Vick | |

* cited by examiner

*Primary Examiner* — Lars A Olson
(74) *Attorney, Agent, or Firm* — Buckingham Doolittle & Burroughs, LLC

(57) ABSTRACT

An architecture is presented that provides a glow in the dark flotation device that increases the likelihood of quickly locating individuals lost in water by increasing the visibility of the user, and more particularly to a durable conventional life jacket having a phosphorescent portion that emits visible light under low-light conditions.

6 Claims, 5 Drawing Sheets

GLOW-IN-THE-DARK LIFE JACKET

CROSS-REFERENCE

This application claims priority from Provisional Patent Application Ser. No. 61/426,005 filed Dec. 22, 2010.

FIELD OF THE INVENTION

This invention pertains generally to a glow-in-the-dark life jacket that aids rescuers in quickly locating individuals lost in water, and more particularly to a durable conventional life jacket having a phosphorescent portion that illuminates under low-light conditions.

BACKGROUND

Many individuals enjoy a variety of professional and recreational water sports and activities, most of which require or benefit from the use of a personal flotation device such as a life jacket for safety. While traditional life jackets may keep an individual in the water afloat, the life jackets may not provide an obvious indication of individuals' locations in the event of an emergency. This is of particular concern during situations when an individual becomes lost at night or in dark, choppy waters. The dingy colors of conventional life jackets may prevent rescuers from easily spotting victims, further delaying the rescue process.

Therefore, a flotation device that increases the visibility of a user would be advantageous. The proposed invention allows a rescuer to more easily visualize an individual floating in water in the dark or under low-light conditions. This increased visibility increases the likelihood of a successful retrieval or rescue of the wearer.

SUMMARY

Accordingly, the present invention overcomes the limitations of the prior art by providing a unique and useful glow in the dark life jacket that increases the visibility of a user lost in the water especially under low-light conditions.

The following presents a simplified summary in order to provide a basic understanding of some novel embodiments described herein. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a flotation device for water safety that is visible in low-light conditions. In one embodiment, the flotation device comprises an outer surface visible in low-light conditions with at least one securing element for securing the flotation device to a user. Preferably, the flotation device comprises a life jacket with at least one glow in the dark element that is photoluminescent following sufficient exposure to a recharging source.

The life jacket helps keep the user afloat when in the water under any light condition. However, when the user is in or near the water at night or in other low-light scenarios, the glow in the dark element radiates visible light enabling a companion or a rescuer to better visualize the user. Further, the glow in the dark element is rechargeable following exposure to a recharging source. The life jacket can be used to increase the user's safety in a wide variety of water related activities, namely, boating, skiing, wakeboarding, fishing, and the like.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

DETAILED DESCRIPTION

Figure 1:
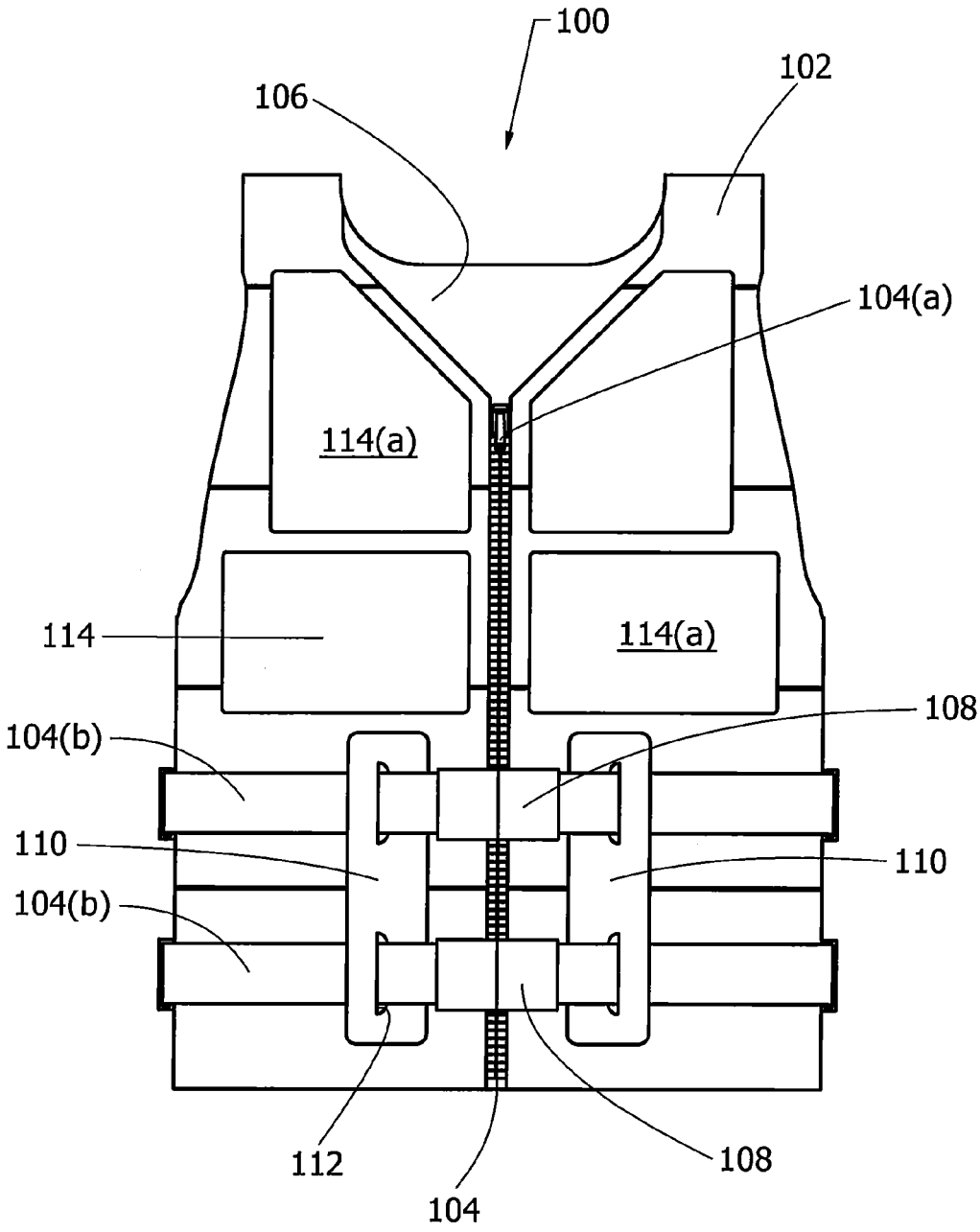
FIG. 1 illustrates a perspective view of a glow in the dark flotation device in accordance with the disclosed architecture.

Safety of individuals on or near the water is of paramount importance to people who enjoy or engage in recreational and professional water sports and activities. Accordingly, the disclosed device is designed for individuals who desire a life jacket that has increased visibility under low-light conditions. The device allows companions and rescue personal to better visualize individuals in or near the water, thereby increasing the likelihood of a successful retrieval or rescue if required.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modifications, equivalents, and alternatives falling within the spirit and scope of the claimed subject matter. The invention relates generally to a photoluminescent flotation device for improved visibility of a user in or near the water under less than ideal visibility conditions such as at night.

Referring initially to the drawings, FIG. 1 illustrates a flotation device 100. The flotation device 100 comprises an outer surface 102 visible under low-light conditions and at least one securing element 104. The flotation device 100 comprises a core material (not shown), typically a closed-cell foam such as cross linked polyethylene. However, the core material may also comprise polyethylene, MLC flotation foam, polyvinyl chloride, neoprene, polystyrene, and the like; and any other suitable material including any nonabsorbent buoyant material known to one of skill in the art. These materials allow the flotation device 100 to be substantially water proof. In addition, the buoyancy of these materials allows a user (not shown) to remain afloat in water when properly secured to the flotation device 100. While the flotation device 100 illustrated in FIG. 1 is typically a foam core sleeveless life jacket/vest, the inventor also recognizes other aquatic variations where the flotation device 100 is an inflatable, a life preserver, an animal flotation device, and the like. Similarly, non-aquatic applications, such as a highly visible protective outer garment (not shown) for snow skiing, bicycling, or running are also contemplated.

Furthermore, the outer surface 102 preferably covers the core material of the flotation device 100 so that the core material is completely encapsulated. In other words, the core material of the flotation device 100 is sandwiched or positioned inside of the material comprising the outer surface 102 of the flotation device 100. The outer surface 102 material may comprise nylon, plastic, poly vinyl chloride sheeting, polyester, polymers, canvas, fabric, or any other flexible water resistant covering material known to one of skill in the art.

When utilized, the flotation device 100 drapes around the user's neck and substantially encapsulates the user's torso so that the user's head and arms remain uncovered and unencumbered. Next, the at least one securing element 104 is used to keep the flotation device 100 in place around the user. The at least one securing element 104 may comprise an attachment element, a zipper, a releasable closure mechanism, a buckle and straps, hook and loop fasteners, and the like, or any combination thereof.

Preferably, the at least one securing element 104 comprises a zipper mechanism 104(*a*) for securing a torso opening (not shown) running perpendicularly down the front of the flotation device 100 from a neck hole 106 to the bottom of the flotation device 100. In addition, the at least one securing element 104 further preferably comprises a plurality of adjustable nylon straps 104(*b*), typically between one and four in number, that run horizontally across the front of the flotation device 100. However, this is not meant as a limitation as any number of the plurality of straps 104(*b*) may be used in any orientation, diagonally for example, as desired. The plurality of straps 104(*b*) typically fixedly attach to the sides of the flotation device 100, extend toward the front and terminate medially into a corresponding plurality of buckle mechanisms 108. However, the plurality of straps 104(*b*) may be attached to any point on the flotation device 100, such as on the side, by sewing, radio frequency welding, glue, adhesive, rivets, snaps, and the like, and by any other method known to one of skill in the art for attaching similar materials. Similarly, the plurality of straps 104(*b*) may even completely encircle the flotation device 100 as desired. While the plurality of straps 104(*b*) are typically nylon, any strapping material known to one of skill in the art may be used as well.

The plurality of straps 104(*b*) may be separated with at least one strap positioning element 110 on both sides of the torso opening (not shown). The plurality of straps 104(*b*) run through a plurality of slots 112 in the at least one strap positioning element 110 so that the plurality of straps 104(*b*) are kept apart at that position on the flotation device 100. The at least one strap positioning element 110 may further comprise a flexible plastic or nylon plate, a band with through holes, and the like. Additionally, the at least one strap positioning element 110 may be attached to the outer surface 102 of the flotation device 100 or may be free floating. The at least one strap positioning element 110 is held in place along the plurality of straps 104(*b*) as the plurality of slots 112 are smaller in dimension than the plurality of buckle mechanisms 108. In other words, the at least one strap positioning element 110 will not fall off the ends of the plurality of straps 104(*b*).

Furthermore, as the outer surface 102 has increased visibility under low-light conditions, either the material of the outer surface 102 and/or at least one glow in the dark element 114 having glow in the dark properties attached to the outer surface 102 are present in the invention. Glow in the dark properties allow for increased visibility of the flotation device 100 once sufficiently charged by a light or other radiation source. For example, the at least one glow in the dark element 114 may be charged when exposed to a light source, for example, sunlight, ultra violet light, LED lights, incandescent lights, fluorescent lights, and the like. Once charged, the at least one glow in the dark element 114 will photoluminesce, or in other words, emit visible light.

Preferably, the flotation device 100 will employ a plurality of the at least one glow in the dark element 114. As seen in FIG. 1, the at least one glow in the dark element 114 may comprise a plurality of phosphorescent panels 114(*a*) of any shape or design. The plurality of phosphorescent panels 114(*a*) may be affixed or attached to the outer surface 102 by sewing, stitching, radio frequency welding, glue, adhesives, heat, or by any other method known to one skilled in the art. Additionally, the plurality of phosphorescent panels 114(*a*) may be attached to the outer surface 102 in a variety of positions and orientations, such as to the front, back, and sides for example.

Furthermore, any external portion on the flotation device 100 may have photoluminescent properties. For example, the flotation device 100 may have the at least one glow in the dark element 114 further comprise glow in the dark decals, patches, bands, letters, numbers, pictures, zippers, straps, buckles, fasteners, strap positioning devices, attachment points, and the like. Similarly, the material of the flotation device 100 and/or the outer surface 102 may comprise a photoluminescent material.

The at least one glow in the dark element 114 of the present invention preferably comprises a photoluminescent compound. This allows the user to be more visible at night or under low-light conditions, as photoluminescent compounds emit visible light following sufficient exposure to a light or other comparable radiation source. Typically, the photoluminescent compound will comprise a phosphorescent material to produce the photoluminescence. For example, a phosphor such as copper or silver activated zinc sulfide may be incorporated into a plastic or other materials that make up the at least one glow in the dark element 114. Another preferred phosphor is europium activated strontium aluminate which is useful because it produces a more persistent and brighter visible light emission. However, these phosphors are not meant as a limitation as there are a wide variety of other phosphors and/or activators known to one skilled in the art that may be used as well.

The photoluminescence typically lasts for a period of time that depends on the length of exposure to the light source, the chemical composition of the phosphor and activator, and the type of radiation used for charging. After the phosphorescence abates, the user simply re-exposes the at least one glow in the dark element 114 to the light source. For example, the flotation device 100 may recharge when left out in the sun. Products made with phosphorescent materials typically maintain their glow in the dark properties for several years as long as they are sufficiently recharged. Also, it is not uncommon for these materials to continue to emit light for up to ten hours or more with each charge.

Additionally, the invention is not limited to phosphor based photoluminescence as fluorescent materials may be used to produce photoluminescence for the flotation device 100. Therefore, chemiluminescent materials which produce visible light through chemical reactions rather that from exposure to a light source may be used as the at least one glow in the dark element 114 as well. For example, commercially available glow in the dark light sticks, which are activated by removing or cracking a barrier between a plurality of reactants, may be used in the at least one glow in the dark element 114 instead of or in conjunction with a phosphor based photoluminescent material to give off light. It may be advantageous to make use of a variety of different materials to produce a plurality of different colors and/or to have a plurality of different glow time periods. Similarly, the flotation device 100 may comprise reflective elements (not shown) in conjunction with the photoluminescent and/or chemiluminescent materials to increase visibility of the flotation device 100 under a variety of weather conditions.

Next, the at least one glow in the dark element 114 may be manufactured into a variety of desired shapes or elements. For example, the plurality of phosphorescent panels 114(*a*) may comprise a phosphor powder or pigment mixed with a polymer to produce a flexible panel that may be attached to the outer surface 102. Similarly, the plurality of buckle mechanisms 108 may be molded or extruded with a phosphor. These processes are not meant as a limitation as a phosphorescent material may be combined with the at least one glow in the dark element 114 by painting, dying, lining, coating, extruding, embedding, casting, dipping, or by any other method of manufacture known to one of skill in the art.

Figure 2:
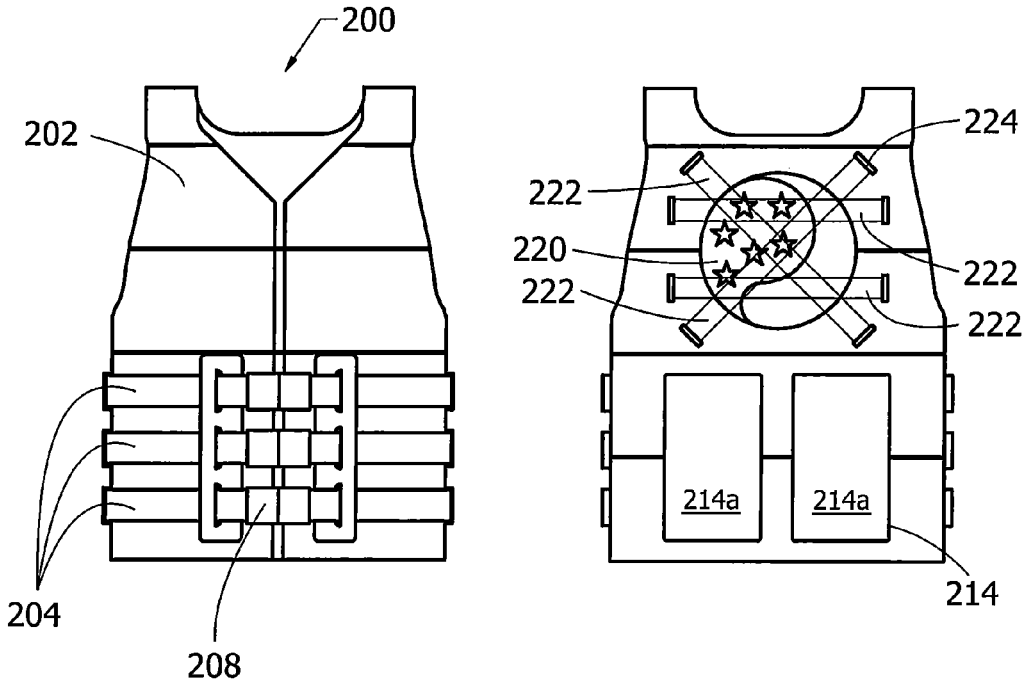
FIG. 2 illustrates a front and rear view of a glow in the dark flotation device in accordance with the disclosed architecture.
Figure 2A:
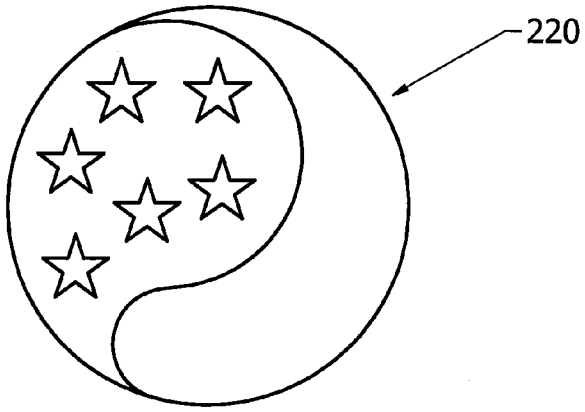
FIG. 2A illustrates a removable decorative insert for use in conjunction with the glow in the dark flotation device in accordance with the disclosed architecture.

In another embodiment as shown in FIGS. 2 and 2A, a flotation device 200 for use as a wakeboarding life jacket comprises an outer surface 202. The flotation device 200 is held in place on a user by a plurality of straps 204 and a plurality of buckle mechanisms 208. At least one glow in the dark element 214, a phosphorescent panel 214(*a*) for example, is attached to the outer surface 202. A plurality of securing bands 222 are used to hold a decorative element 220 in place on the back of the flotation device 200. The plurality of securing bands 222 typically comprise a transparent or photoluminescent material and are attached to the outer surface 202, as discussed supra. Each of the plurality of securing bands 222 may further comprise an adjusting element 224 for selectively loosening and tightening the plurality of securing bands 222. While the embodiment in FIG. 2 illustrates four of the plurality of securing bands 222, two substantially horizontal and two substantially diagonal, any number may be employed in any orientation without deviating from the scope of the invention. Additionally, any other method of securing the decorative element 220 to the outer surface 202, such as with webbing, cords, mesh, and the like may be used.

The decorative element 220 may comprise any design or shape that the user desires that may be held in place by the plurality of securing bands 222. Also, the decorative element 220 may comprise a fluorescent material, a photoluminescent material, or both. To attach the decorative element 220, the user simply loosens the plurality of securing bands 222 with the adjusting element 224, slides the decorative element 220 in place between the plurality of securing bands 222 and the outer surface 202, and then tightens the plurality of securing bands 222 with the adjusting element 224. Additionally, the plurality of securing bands 222 may be photoluminescent, transparent, translucent or may have an opening (not shown) for a transparent or translucent portion (not shown) for accepting a tube or panel of chemiluminescent material such as a glow stick.

Figure 3:
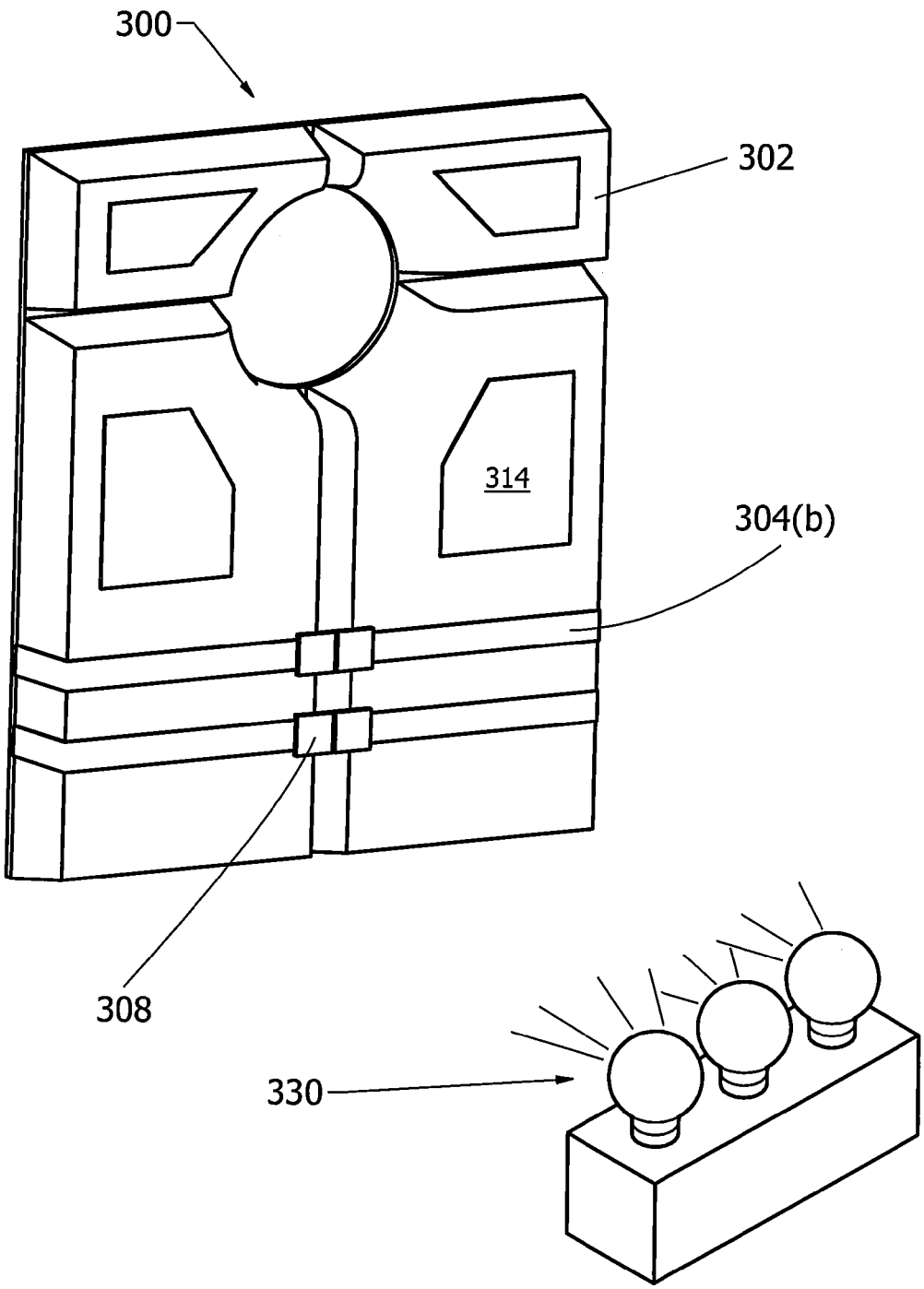
FIG. 3 illustrates a perspective view of a glow in the dark life jacket in accordance with the disclosed architecture.

FIG. 3 illustrates an embodiment of a flotation device 300 suitable for storage without a naturally occurring recharging source such as sunlight. Often, flotation devices, such as life jackets, must be stored out of sight and are only removed in the event of emergency. For example, cruise ships, recreational boaters that must comply with Coast Guard requirements, rescue stations, and the like, often do not have deck or outside space to store these devices. Therefore, while still rechargeable by direct sunlight, the flotation device 300 may also comprise a recharging source 330. The recharging source 330 may provide an artificial or man made light or radiation source so that the flotation device 300 remains charged and ready for use even when stored out of sunlight. The recharging source 330 may comprise an ultraviolet light source, a black light, a light-emitting diode, a visible light source, a battery powered flashlight, and the like. Similarly, the recharging source 330 may comprise elements that emit radiation such as tritium and promethium, for example.

The recharging source 330 may or may not attach to the flotation device 300 as desired. Optionally, the recharging source 330 may simply be clipped on or otherwise affixed anywhere to an outer surface 302 of the flotation device 300. For example, the flotation device 300 may comprise a plurality of straps 304(*b*) with a plurality of buckle mechanisms 308. The recharging source 330 may then clip on or otherwise attach to one of the plurality of straps 304(*b*). The recharging source 330 is used to recharge an at least one glow in the dark element 314, such as a fluorescent panel or other portion of the flotation device 300. Alternatively, the recharging source 330 may simply remain where the flotation device 300 is stored, for example in a cabinet or locker.

Figure 4:
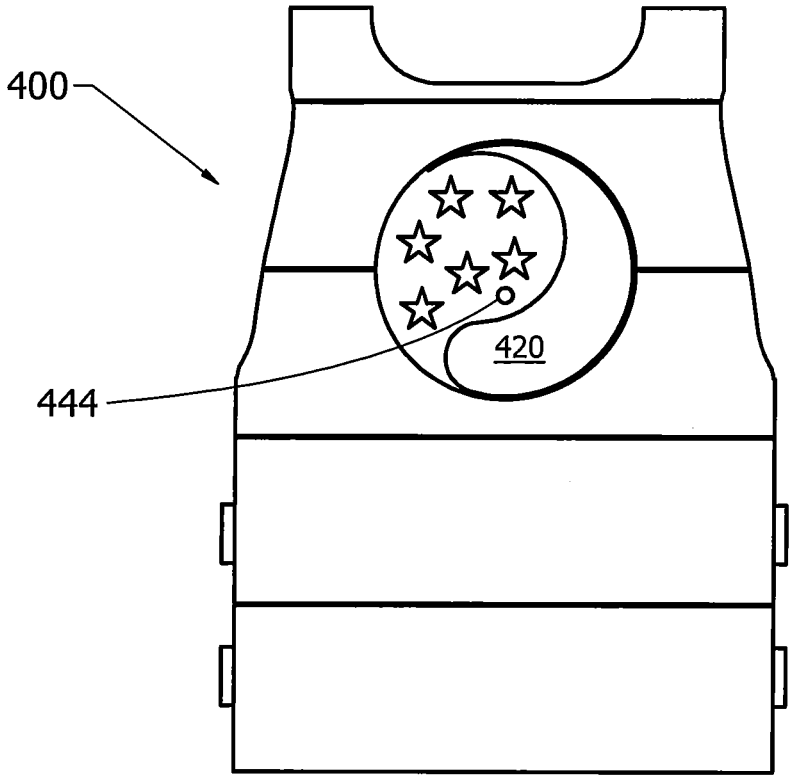
FIG. 4 illustrates a rear view of a glow in the dark flotation device with an attachable decorative element in accordance with the disclosed architecture.
Figure 4A:
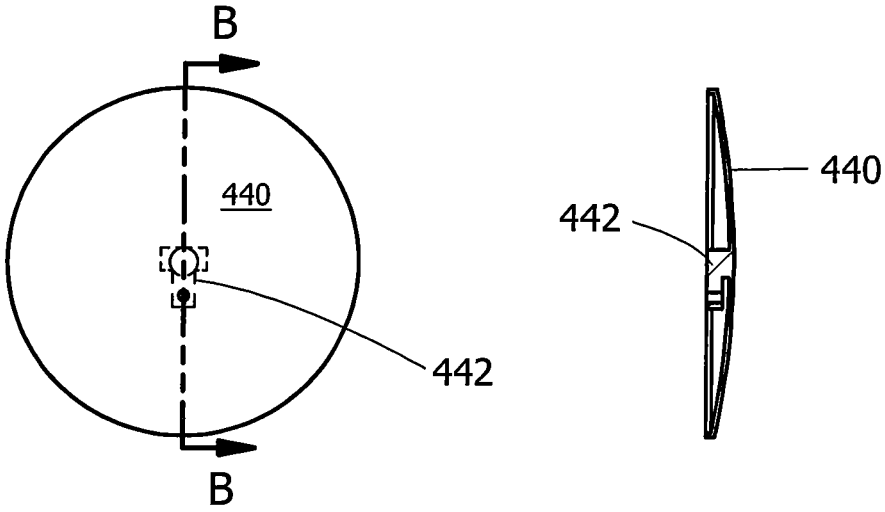
FIG. 4A illustrates an attachment surface for attaching a decorative element.

FIG. 4 illustrates an embodiment of a flotation device 400 that is customizable in design. The back of the flotation device 400 comprises an attachment surface 440 for attaching a decorative element 420. As illustrated in FIG. 4A, the attachment surface 440 is typically a convex disk of material, plastic for example, that is sewn on or otherwise attached, as discussed supra, to the flotation device 400. In addition, the attachment surface 440 may optionally be affixed to the flotation device 400 with a mechanical fastener 444, such as a screw or rivet. Furthermore, the attachment surface further comprises a T-slot 442 for accepting a T-peg 446.

Figure 5A:
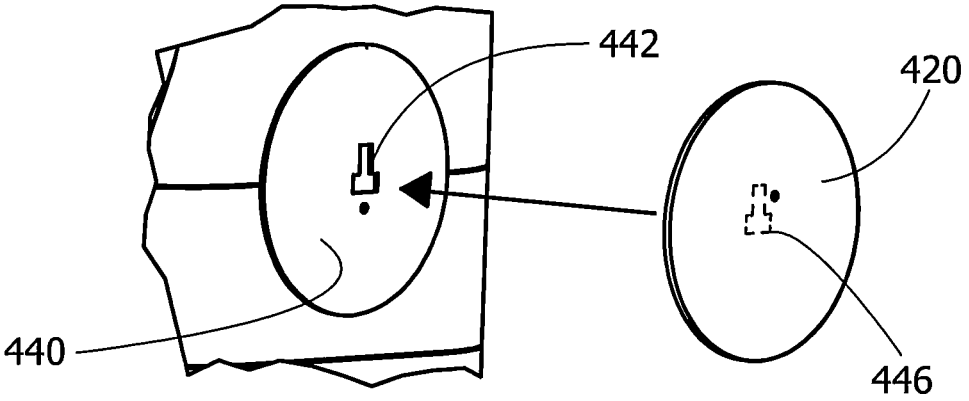
FIGS. 5A-C illustrate a decorative element with a T-peg on the back of the decorative element.
Figure 5B:
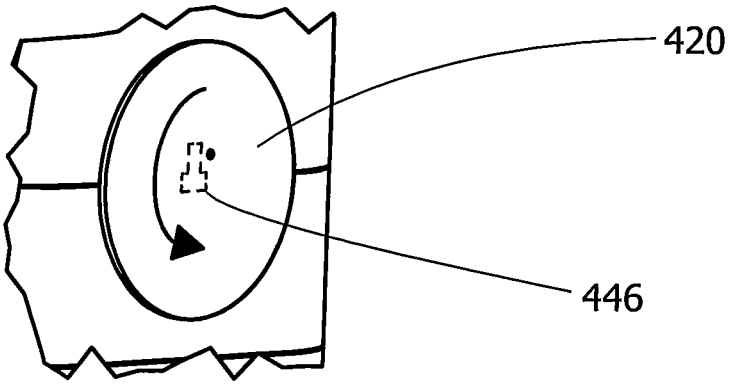
Figure 5C:
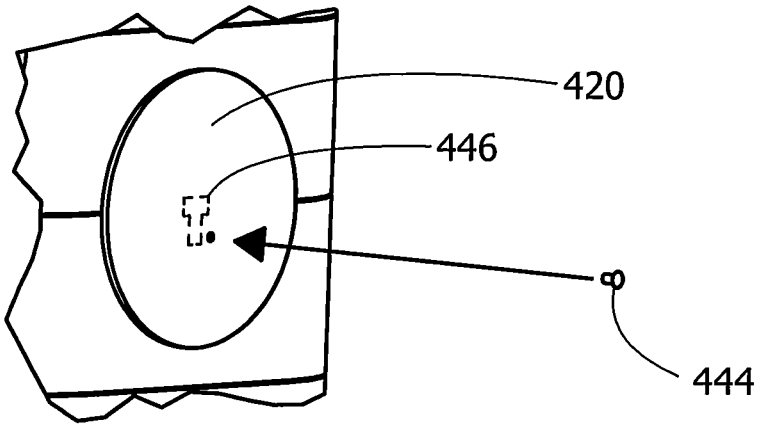

A user may select the decorative element 420 available that is desirable. The decorative element 420 may comprise any design that the user desires, such as a spider shape, a cross, a directional arrow, and a picture for example. As illustrated in FIGS. 5A-C, the decorative element 420 comprises the T-peg 446 on the back of the decorative element 420. The T-peg 446 is orientated upside down on the decorative element 420 as compared to the T-slot 442 in the attachment surface 440. To attach the chosen decorative element 420 to the flotation device 400, the user inserts the T-peg 446 into the T-slot 442. In this position, the decorative element 420 will be orientated upside down on the flotation device 400. The decorative element 420 is then rotated substantially 180 degrees so that it is now upright in orientation. However, the T-peg 446 has rotated substantially 180 degrees as well and in now temporarily locked in position in the T-slot 442. To remove the decorative element 420, the process is simply reversed.

What has been described above includes examples of the disclosed device. It is, of course, not possible to describe every conceivable combination of components and/or methodologies, but one of ordinary skill in the art may recognize that many further combinations and permutations are possible. Accordingly, the novel device is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A life jacket used to emit light when in or around water comprising:

an outer surface visible in the dark comprising at least one glow in the dark element chargeable following an exposure to a source of light, wherein the at least one glow in the dark element is a single layer of material integrated with a phosphor based photoluminescent material; and at least one attachment element for securing the life jacket to a user comprising a plurality of photoluminescent adjustable straps, a plurality of photoluminescent buckles, and at least one strap positioning element for separating the plurality of photoluminescent adjustable straps.

2. The life jacket of claim 1, wherein the at least one glow in the dark element comprises one of the following materials: zinc sulfide or strontium aluminate.

3. The life jacket of claim 2, wherein the outer surface material is a phosphor impregnated plastic.

4. The life jacket of claim 2, wherein the outer surface is lined, dyed, painted, or coated with a layer of a photoluminescent material.

5. The life jacket of claim 4, wherein the outer surface further comprises an attachment surface and a detachable photoluminescent decorative element.

6. The life jacket of claim 5, wherein the detachable photoluminescent decorative element comprises a T-peg for inserting into a T-slot in the attachment surface.

* * * * *